US009016171B2

(12) United States Patent
Chen

(10) Patent No.: US 9,016,171 B2
(45) Date of Patent: Apr. 28, 2015

(54) SHOCK ABSORBING HAMMER

(71) Applicant: Alex Chen, Taichung (TW)

(72) Inventor: Alex Chen, Taichung (TW)

( * ) Notice: Subject to any disclaimer, the term of this patent is extended or adjusted under 35 U.S.C. 154(b) by 218 days.

(21) Appl. No.: 13/865,994

(22) Filed: Apr. 18, 2013

(65) Prior Publication Data

US 2014/0311299 A1 Oct. 23, 2014

(30) Foreign Application Priority Data

Mar. 7, 2013 (TW) ..... 102107973 A

(51) Int. Cl.
*B25D 1/12* (2006.01)
*B25D 1/02* (2006.01)

(52) U.S. Cl.
CPC .. *B25D 1/12* (2013.01); *B25D 1/02* (2013.01); *B25D 2222/42* (2013.01); *B25D 2222/54* (2013.01); *B25D 2250/321* (2013.01); *B25D 2250/355* (2013.01)

(58) Field of Classification Search
CPC ..... B25D 1/12; B25D 1/02; B25D 1/14; B25G 1/00; B25G 1/01
USPC ..... 81/22
See application file for complete search history.

(56) References Cited

U.S. PATENT DOCUMENTS

| | | | | |
|---|---|---|---|---|
| 2,989,101 | A * | 6/1961 | Carmien | 81/19 |
| 3,088,506 | A * | 5/1963 | Bianchini | 81/19 |
| 4,039,012 | A * | 8/1977 | Cook | 81/22 |
| 5,960,677 | A * | 10/1999 | Carmien | 81/22 |
| 6,595,087 | B2 * | 7/2003 | Whalen et al. | 81/22 |

* cited by examiner

*Primary Examiner* — David B Thomas

(57) ABSTRACT

The present invention relates to a shock absorbing hammer whose head has housings filled with pellet assembly inside. The pellet assembly includes both rigid pellets and soft pellets to absorb shock from external striking force impacted on the head of the main frame.

17 Claims, 8 Drawing Sheets

SHOCK ABSORBING HAMMER

FIELD OF THE INVENTION

The present invention relates to a shock absorbing hammer, particularly to a hammer whose head tube is filled with rigid and soft pellets inside for improving its shock absorbing result against external striking force.

BACKGROUND OF THE INVENTION

According to the prior art of a dead blow hammer disclosed in U.S. Pat. No. 6,595,087, its head tube is filled with specific amount of rigid pellets which are rollable within the tube. Both distal ends of the head have an opening and two end caps are fitted respectively inside the open ends of the head tube for closure. On one side of the head tube is vertically extended a neck tube in its center portion to integrate with a handle to form a complete hammer.

There are certain disadvantages from the prior art:

1. The rigid pellets are made of single material which cannot effectively inhibit their rebound.
2. The movement of the pellets is unpredictable and unstable due to the bulky head tube. Because of the unpredictable rebound of the pellets, it is easy to hurt user's hand.
3. Inasmuch as the pellets dash against each other in the head tube, the rigid surfaces of the pellets are easy to be damaged. The movement of the pellets is consequently hindered, and the function of shock absorbing is relatively decreased.
4. The head tube is hollow with shell structure which is not durable enough to bear external striking force.

SUMMARY OF THE INVENTION

The object of the present invention is to provide a shock absorbing hammer with improved stability and shock absorbing result. In order to achieve the foregoing object, the main frame has two separated housings disposed along its longitudinal axis. Each housing is filled with pellet assembly, a mixture of a specific amount of rigid pellets and a specific amount of soft pellets.

DETAILED DESCRIPTION OF THE PREFERRED EMBODIMENT

Figure 1:
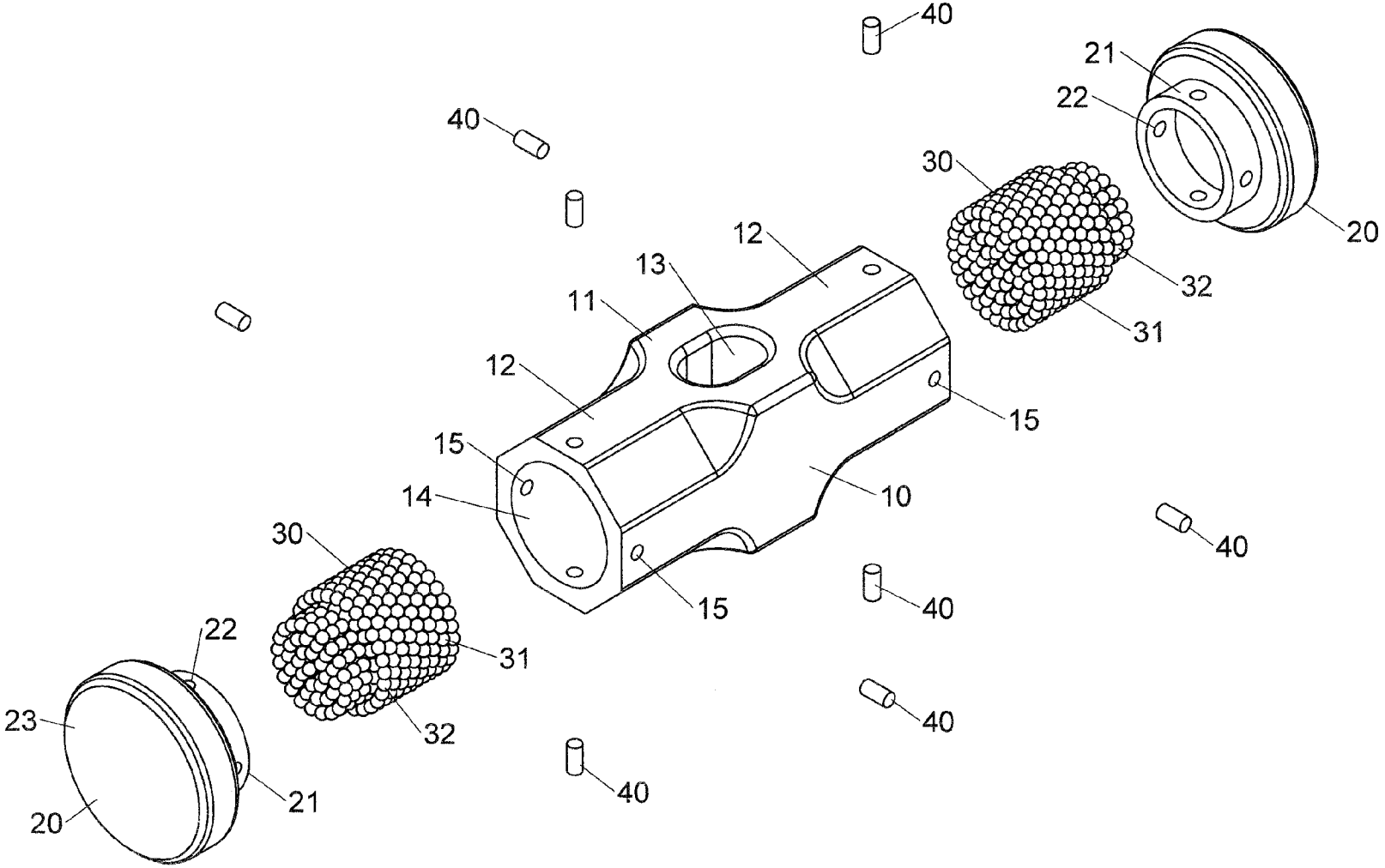
FIG. 1 is an exploded perspective drawing of the present invention.

Referring to FIG. 1 the shock absorbing hammer of the present invention comprises a head main frame 10, two end cap assembly 20, two sets of pellet assembly 30 and a plurality of rabbet elements 40.

The main frame 10 has a center portion 11 and two extended portions 12 disposed along its longitudinal axis. The two extended portions 12 are disposed at two sides of the center portion 11 respectively. Cross sections of the center portion 11 and the extended portion 12 appear in different shapes. The cross section of the center portion 11 is quadrilateral, spherical or any other shape and the cross section of the extended portion 12 is octagonal. The center portion 11 is laterally penetrated by a first rabbet joint 13 which is a slot for a handle to rabbet. Inside each extended portion 12 is a cylindrical housing 14 with one open end at the distal end of the extended portion 12. The housing 14 does not communicate with the first rabbet joint 13 and the two housings 14, separated by the center portion 11, do not communicate with each other either. There is a plurality of second rabbet joints 15 perforated at the end portion of the extended portion 12 and circularly disposed along the longitudinal axis of the main frame 10.

The end cap assembly 20 is integrated with the extended portion 12 for closure of the housing 14 and has a protruded rabbet flange 21 to fit in the housing 14. There is a plurality of third rabbet joints 22 disposed on the rabbet flange 21 to exactly couple with the second rabbet joints 15. The end cap assembly 20 also has cambered convex surface 23 disposed at its exterior end.

The pellet assembly 30 is fully packed in the housing 14 or packed with 70% at least. The pellet assembly 30 includes a mixture of a specific amount of rigid pellets 31 and a specific amount of soft pellets 32. The size of the rigid pellet 31 and the soft pellet 32 could be the same, the rigid pellet 31 bigger than the soft pellet 32, or the other way around. The amount ratio of the rigid pellet 31 and the soft pellet 32 is 1:1~1.5:1. The material of the rigid pellet 31 is metal such as steel, and the material of the soft pellet 32 is plastic, rubber or the other soft substance.

The rabbet element 40 is employed to rabbet the second rabbet joint 15 and the third rabbet joint 22 of the end cap assembly 20. The mechanism between each rabbet element 40 and each second rabbet joint 15, or each rabbet element 40 and each third rabbet joint 22, is tightly fitted. Therefore, the end cap assembly 20 can be tightly integrated with the extended portion 12 for closure of the housing 14.

Figure 2:
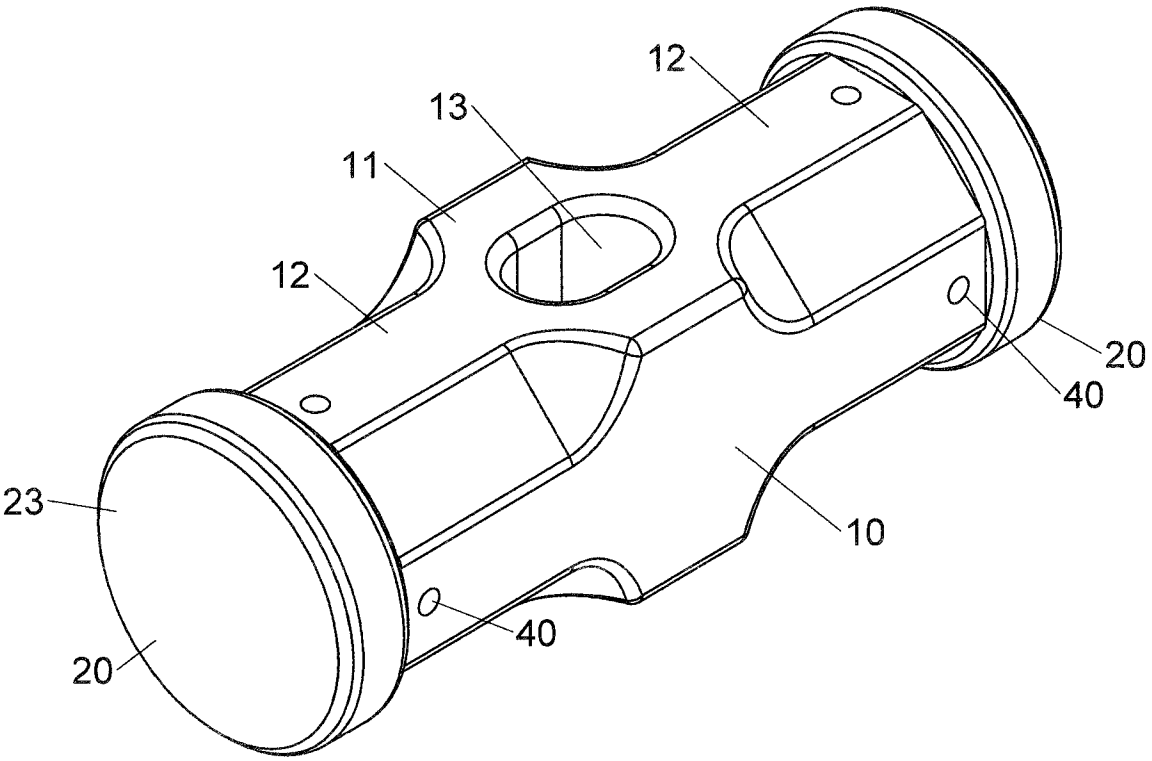
FIG. 2 is an assembled perspective drawing of the present invention.
Figure 3:
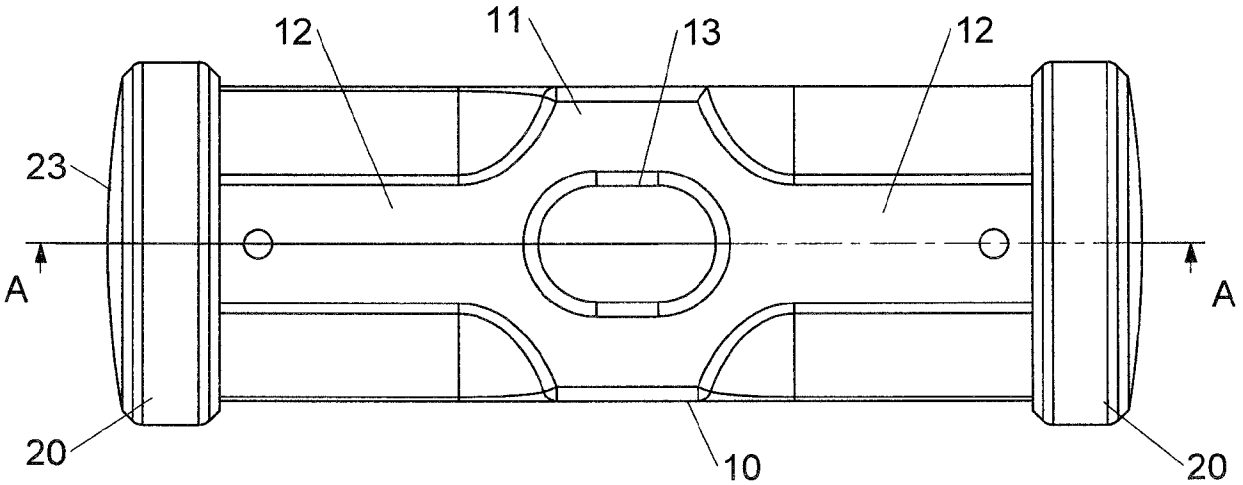
FIG. 3 is a top view of the present invention.

When two sets of pellet assembly 30, two end cap assembly 20 and a plurality of rabbet elements 40 are integrated with the main frame 10, the finally assembly is shown as in FIG. 2. The rigid pellets 31 and the soft pellets 32 are thoroughly mixed in each pellet assembly 30. Because it is difficult to draw thorough mixture by computer graphics in FIG. 4, it is presented in linear array. Once the pellet assembly 30 is lodged in the housing 14, the rigid pellets 31 and the soft pellets 32 will eventually be thoroughly mixed by shaking the main frame 10 several times.

Figure 4:
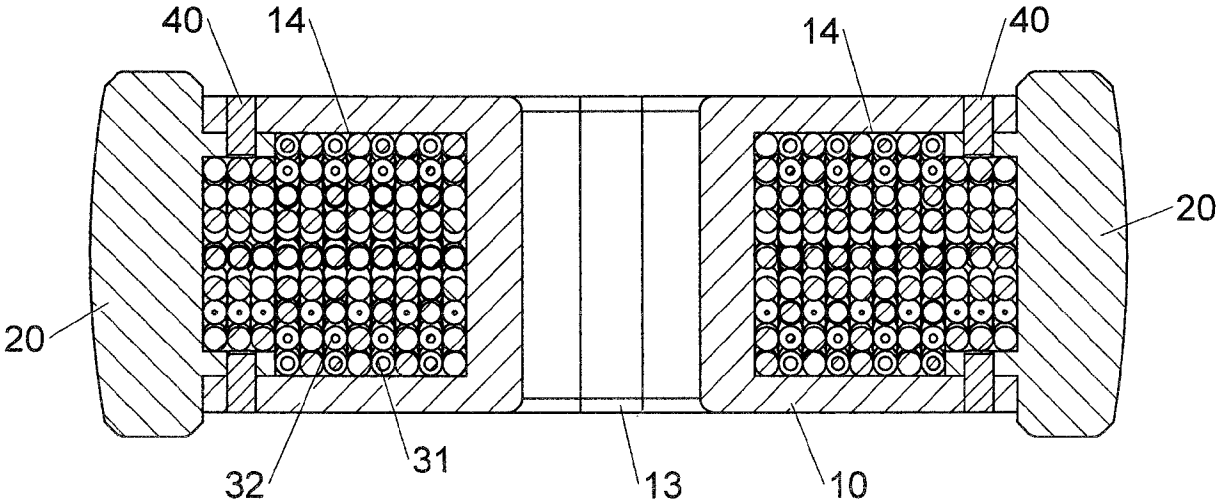
FIG. 4 is a cross sectional view taken along a plane A-A in FIG. 3 of the present invention.

Referring to FIG. 4, when the end cap assembly 20 gets impact, the striking force applied on the end cap assembly 20 is sustained by the pellet assembly 30 and the main frame 10, mostly by the pellet assembly 30. When the pellet assembly 30 sustains the striking force, the force is dispersed by the rigid pellets 31 and then fully absorbed the soft pellets 32. Therefore, the impact of a strike is mostly decreased by the pellet assembly 30. This is the main advantage of the present invention.

Figure 5:
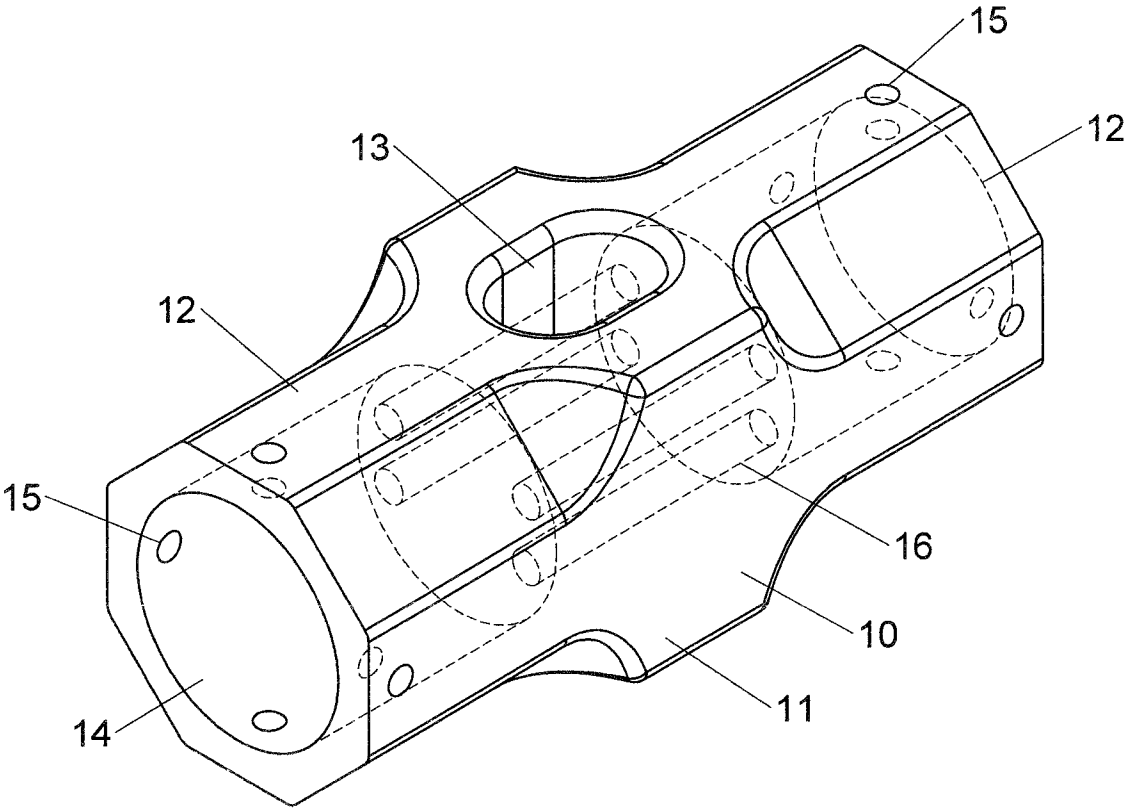
FIG. 5 is an exploded perspective drawing of the second embodiment in accordance with the present invention.

Referring to FIG. 5, in the second embodiment of the present invention, the center portion 11 of the main frame 10 has a plurality of long thru-holes 16 which communicate two housings 14 but do not communicate with the first rabbet joint 13. The thru-holes 16 are circularly disposed along the longitudinal axis of the main frame 10.

Figure 6:
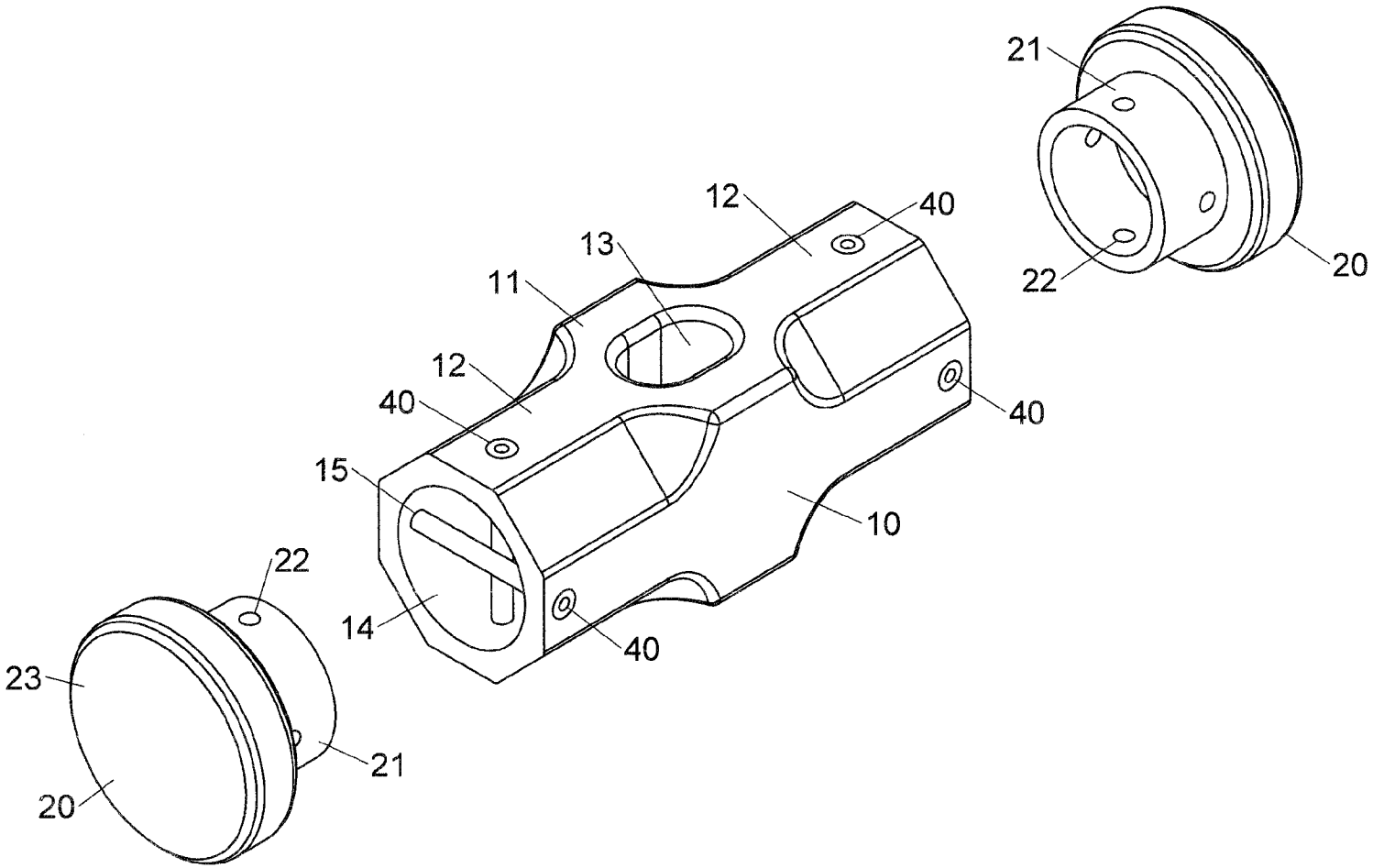
FIG. 6 is an exploded perspective drawing of the third embodiment in accordance with the present invention.

Referring to FIG. 6, in the third embodiment of the present invention, the rabbet element 40 is riveted in the second rabbet joint 15 of the main frame 10. The second rabbet joint 15 is staggered against the adjacent one but leveled at the opposite one, so that two rabbet elements 40 riveted in the second rabbet joints 15 will be staggered.

Figure 7:
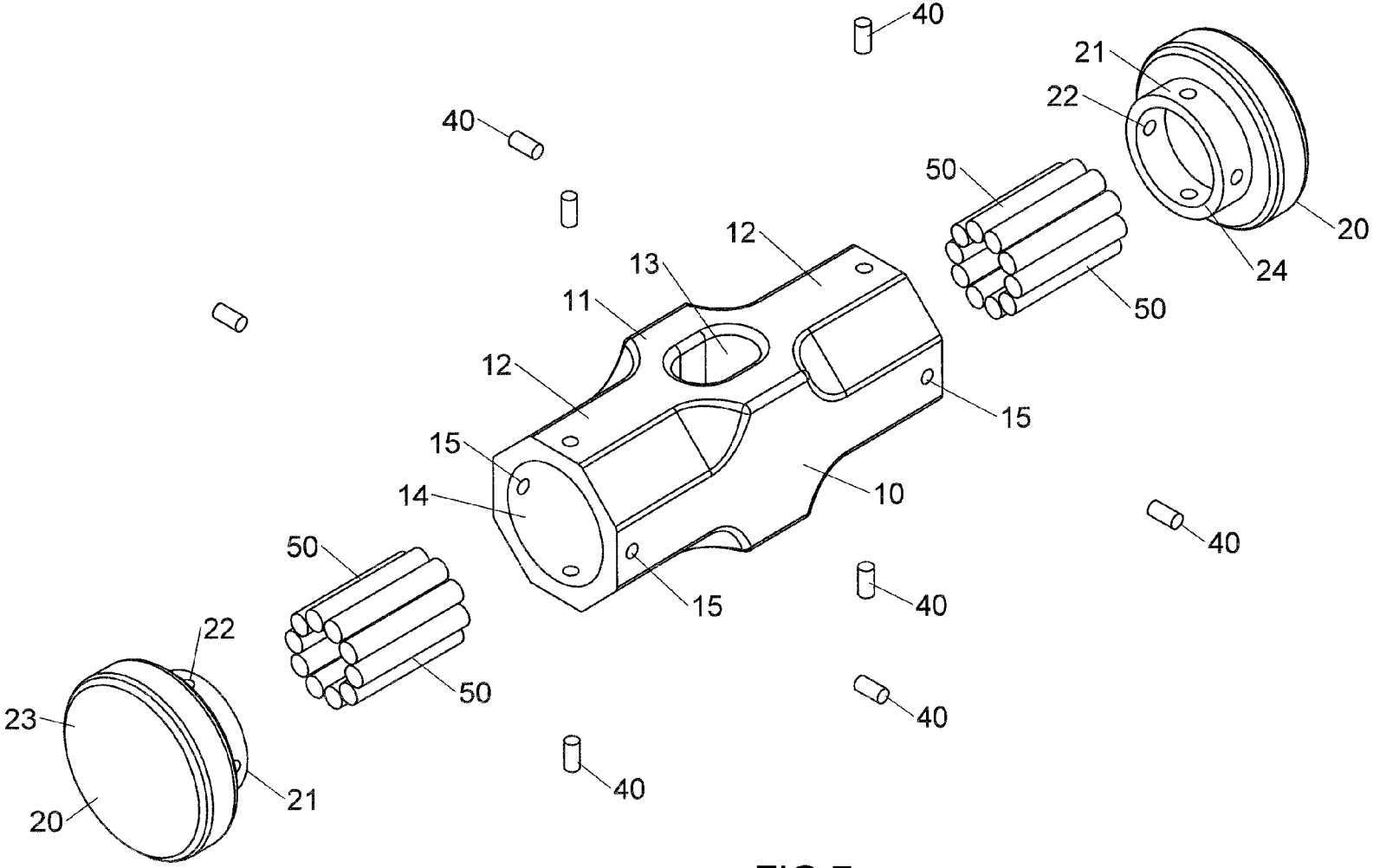
FIG. 7 is an exploded perspective drawing of the fourth embodiment in accordance with the present invention.

Referring to FIG. 7, in the fourth embodiment of the present invention, the rabbet flange 21 of the end cap assembly 20 has an interior periphery 24. There is a plurality of brackets 50 lodged in the housing 14 of the main frame 10. The brackets 50 are long rods and are embraced by pellets of the pellet assembly 30. One end of each bracket 50 props against the bottom of the housing 14 and the other end against the end cap assembly 20. The exterior periphery of the brackets 50 exactly fits the interior periphery 24, and the brackets 50 are circularly disposed along the longitudinal axis of the main frame 10.

Figure 8:
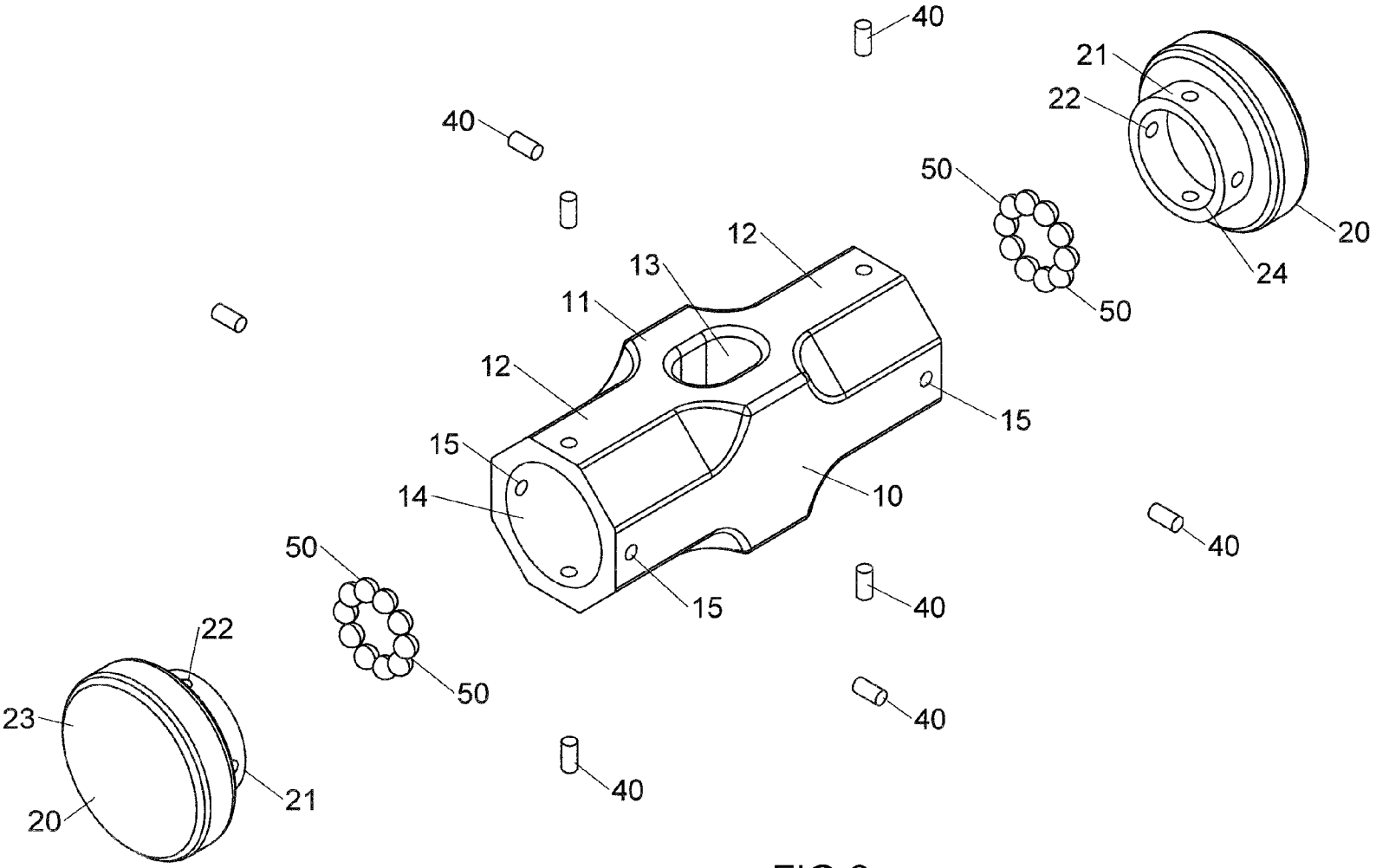
FIG. 8 is an exploded perspective drawing of the fifth embodiment in accordance with the present invention.

Referring to FIG. 8, in the fifth embodiment of the present invention, the brackets 50, different from the fourth embodiment, are spheroids.

Figure 9:
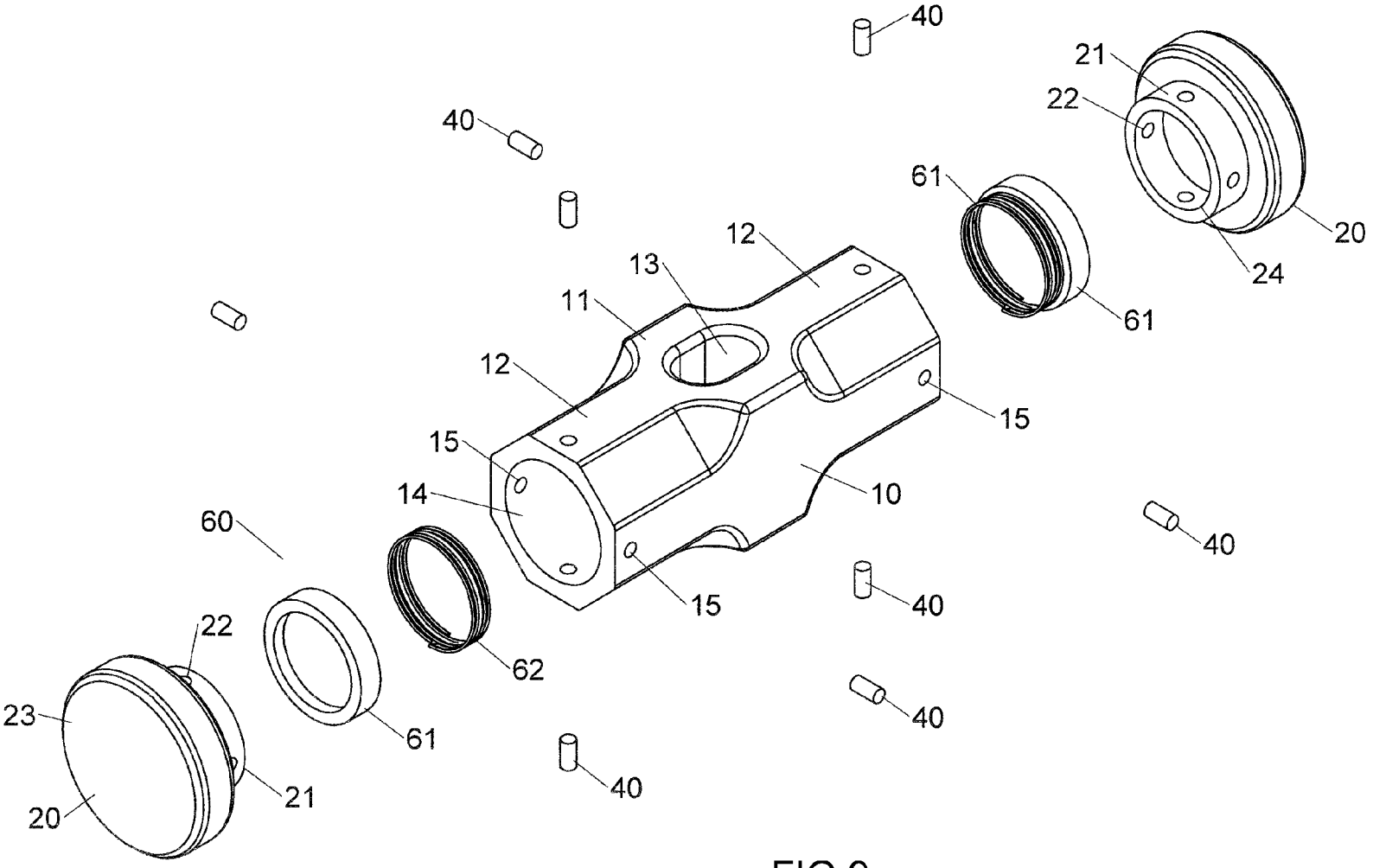
FIG. 9 is an exploded perspective drawing of the sixth embodiment in accordance with the present invention.

Referring to FIG. 9, in the sixth embodiment of the present invention, a spacer assembly 60 is disposed in the housing 14 of the main frame 10. The spacer assembly 60 includes a spacer 61 and an elastic member 62. The spacer 61 is disposed on the top of the elastic member 62 and under the pellet assembly 30 as an elastic cushion.

In another embodiment of the present invention, the end cap assembly 20 has a convex surface 23 with embossment, granule or other patterns. The rabbet element 40 is adhered, welded or other integral mechanism to rabbet with the second rabbet joint 15 of the main frame 10. In the present invention, the rigid pellets 31 and the soft pellets 32 of the pellet assembly 20 are spheroids, and their diameter is better not greater than 2 millimeters. Referring to FIG. 4, the thickness between the housing 14 of the main frame 10 and the side wall of the first rabbet joint 13 is better not less than 8 millimeters.

Advantages of the present invention are summarized as bellow.

1. The striking force impacted on the end cap assembly 20 is mostly dispersed by the rigid pellets 31 and then absorbed the soft pellets 32. Therefore, it is more effective to absorb shock from external striking force.

2. Once the pellet assembly 30 is lodged in the housing 14, the rigid pellets 31 and the soft pellets 32 can be thoroughly mixed by shaking the main frame 10 several times. The design is simple and swift.

3. The main frame 10 has a first rabbet joint 13 and two housings 14 which are hollow portions. The thickness of the wall of the first rabbet joint 13 can improve the strength of the main frame 10.

4. The rigid pellets 31 and the soft pellets 32 are fully mixed to reduce direct bumping of the rigid pellets 31. Therefore, the pellet assembly 30 is more durable.

5. Inasmuch as the pellet assembly 30 is disposed in two housings 14 to limit the moving space of pellets and effectively inhibit their rebound, it reduces the possibility of hurting user's hand.

While we have shown and described the embodiment in accordance with the present invention, it should be clear to those skilled in the art that further embodiments may be made without departing from the scope of the present invention.

What is claimed is:

1. A shock absorbing hammer, comprising:

a main frame having a center portion and two extended portions disposed along its longitudinal axis; said two extended portions being disposed at two sides of said center portion respectively; said center portion being laterally penetrated by a first rabbet joint which is a slot for a handle to rabbet; a plurality of second rabbet joints being perforated at the end portion of said extended portion and circularly disposed along the longitudinal axis of said main frame;

two housings being disposed in said two extended portions and separated by said center portion; each housing, with one open end, being located at the distal end of said extended portion and not communicating with said first rabbet joint;

two end cap assembly being integrated with said extended portion for closure of said housing and having a protruded rabbet flange to fit in said housing; a plurality of third rabbet joints being disposed on said rabbet flange to exactly couple with said second rabbet joints; a cambered convex surface being disposed at the exterior end of said end cap assembly;

two pellet assembly being fully packed in each housing or packed with 70% at least; said pellet assembly including a mixture of a specific amount of rigid pellets and a specific amount of soft pellets; the amount ratio of said rigid pellet and said soft pellet being 1:1~1.5:1; the material of said rigid pellet being steel, and the material of said soft pellet being plastic or rubber; said rigid pellets and said soft pellets of said pellet assembly are spheroids; and a plurality of rabbet elements being employed to rabbet said second rabbet joint of said main frame and said third rabbet joint of said end cap assembly; the mechanism between each rabbet element and each second rabbet joint, or each rabbet element and each third rabbet joint, being tightly fitted for said end cap assembly being tightly integrated with said extended portion of said main frame for closure of said housing.

2. The shock absorbing hammer as claimed in claim 1, wherein, the cross section of said center portion is quadrilateral and the cross section of said extended portion is octagonal.

3. The shock absorbing hammer as claimed in claim 1, wherein, said two housings are separated by said center portion and do not communicate with each other.

4. The shock absorbing hammer as claimed in claim 1, wherein, said housings are cylindrical troughs.

5. The shock absorbing hammer as claimed in claim 1, wherein, said pellet assembly is packed at least 70% in said housing.

6. The shock absorbing hammer as claimed in claim 1, wherein, the material of said rigid pellet is steel and the material of said soft pellet is plastic or rubber.

7. The shock absorbing hammer as claimed in claim 1, wherein, said rigid pellets and said soft pellets of said pellet assembly are spheroids.

8. The shock absorbing hammer as claimed in claim 1, wherein, the size of said rigid pellet is equal to or bigger than the size of said soft pellet.

9. The shock absorbing hammer as claimed in claim 1, wherein, said center portion has a plurality of long thru-holes which communicate two housings and said thru-holes are circularly disposed along the longitudinal axis of said main frame.

10. The shock absorbing hammer as claimed in claim 1, wherein, said rabbet element is riveted in said second rabbet joint of said main frame, and said second rabbet joint is staggered against the adjacent one but leveled at the opposite one so that two rabbet elements riveted in said second rabbet joints will be staggered.

11. The shock absorbing hammer as claimed in claim 1, wherein, said rabbet flange of said end cap assembly has an interior periphery and there is a plurality of brackets lodged in said housing; said brackets are long rods and are embraced by said pellet assembly; one end of said bracket props against the bottom of said housing and the other end against said end cap assembly; the exterior periphery of said brackets exactly fits said interior periphery; and said brackets are circularly disposed along the longitudinal axis of said main frame.

12. The shock absorbing hammer as claimed in claim 11, wherein, said brackets are spheroids.

13. The shock absorbing hammer as claimed in claim 1, wherein, a spacer assembly is disposed in said housing; said spacer assembly includes a spacer and an elastic member; and said spacer is disposed on the top of said elastic member and under said pellet assembly as an elastic cushion.

14. The shock absorbing hammer as claimed in claim 1, wherein, said end cap assembly has a convex surface with embossment or granule patterns.

15. The shock absorbing hammer as claimed in claim 1, wherein, said rabbet element is adhered or welded to rabbet with said second rabbet joint.

16. The shock absorbing hammer as claimed in claim 1, wherein, the diameter of said rigid pellets and said soft pellets is equal to or less than 2 millimeters.

17. The shock absorbing hammer as claimed in claim 1, wherein, the thickness between said housing and the side wall of said first rabbet joint is better not less than 8 millimeters.

* * * * *